United States Patent [19]

Behrens

[11] Patent Number: 4,635,706

[45] Date of Patent: Jan. 13, 1987

[54] MOLTEN METAL HANDLING SYSTEM

[75] Inventor: Hugh C. Behrens, Angleton, Tex.

[73] Assignee: The Dow Chemical Company, Midland, Mich.

[21] Appl. No.: 741,782

[22] Filed: Jun. 6, 1985

[51] Int. Cl.[4] ..... B22D 37/00; B22D 27/02

[52] U.S. Cl. ..... 164/500; 164/133; 164/147.1; 164/113; 222/591; 222/593

[58] Field of Search ..... 164/147.1, 466, 500, 164/133, 135, 322, 420, 337, 113; 222/593, 596, 591

[56] References Cited

U.S. PATENT DOCUMENTS 3,972,369 8/1976 Carbonnel ..... 164/147.1

FOREIGN PATENT DOCUMENTS 45-32834 10/1970 Japan ..... 164/113
48-13214 4/1973 Japan ..... 164/147.1
57-97860 6/1982 Japan ..... 164/66.1

*Primary Examiner*—Kuang Y. Lin
*Attorney, Agent, or Firm*—M. W. Barrow

[57] ABSTRACT

There is disclosed a combination of several novel elements in combination with improved designs of existing elements, to provide a relatively simple means for delivering high melting molten metals, such as magnesium and its alloys, to a continuous caster without exposure of the metal to the ambient atmosphere, at reproducible pressures and quantities to enable the advanced casting technologies to be utilized to their fullest potential. Thus in accordance with the present invention there is described a molten metal handling system, particularly useful for delivering high melting temperature metals in their molten state from a melting pot or crucible to a casting machine, e.g. die caster, strip caster, sand molds and the like, remote from the melting pot or crucible without exposure to the ambient atmosphere. The essential elements of the present molten metal handling system are a pump and heated conduits to carry the molten metal to the casting station. Preferred elements in addition to the pump and conduit are flowmeters and flow control elements. Optionally, two or more sources of molten metal, e.g. two remote crucible or melting pots, can be tied together to provide a continuous source of metal to one or more die casters or strip caster.

5 Claims, 6 Drawing Figures

SECTION - PUMP ASSEMBLY

SHOT SIZE AND DELIVERY APPARATUS

FLOWMETER

FLOWMETER

MOLTEN METAL HANDLING SYSTEM

CROSS REFERENCE TO RELATED APPLICATIONS

The invention described herein is related to my copending U.S. application Ser. No. 720,434, filed Apr. 5, 1985, entitled "Annular Linear Induction Pump with an Externally Supported Duct"; Ser. No. 741,939, filed June 6, 1985, entitled "Flat Linear Flowmeter"; Ser. No. 743,442 filed June 13, 1985 entitled "Annular Linear Induction Flowmeter"; Ser. No. 743,343, filed June 11, 1985 entitled "Molten Metal Shot Size and Delivery Mechanism For Continuous Casting Operations".

BACKGROUND OF THE INVENTION

Within the last fifty years the art of metal casting has made significant advances with the advent of rotary die casting machines and continuous strip casters. While advances have been made in the die casting machines only a few changes have occurred in the techniques for delivery of the molten metal to the machine. The industry still delivers the molten metal to the machine in heated ladles or heated tiltable crucibles. Several innovations which seemed logical, e.g. molten metal pumps based on the Einstein design, heated troughs and/or pipes, shot size delivery apparatus and the like have not been universally employed. Some of the disadvantages of such art equipment are that for the higher melting metals, e.g. magnesium or aluminum, the pumps have required external cooling or extended shafts to place the motor away from the high heat zone of the crucible or melting pot. Each of these aspects has apparent problems obvious to those skilled in the art. Likewise, heated troughs and/or piping has been employed to deliver the molten metal from the pump or a tiltable crucible or raised plugged crucible. These containing and directing pipes and troughs usually are heated by gas fired burners or electrical resistance heating technique through the metal. The disadvantage of each technique is obvious, the gas fired heaters create an undesirable work place environment and the resistance heaters are difficult to control when a molten metal is the resistance.

In addition, most of the systems expose the molten metal to the ambient atmosphere permitting oxidation of the metal resulting in metal oxide impurities in the castings and generally poor quality castings. The extent of oxidation losses is particularly detrimental to magnesium castings.

Further, none of these systems is readily controlled to enable repetitive shot or draw conditions to be automatically uniform.

SUMMARY OF THE INVENTION

The present invention, by combining several novel elements with improved design of existing elements, provides a relatively simple means for delivery of high melting molten metals, such as magnesium and its alloys, to a continuous caster without exposure of the metal to the ambient atmosphere, at reproducible pressures and quantities to enable the advanced casting technologies to be utilized to their fullest potential.

These and other advantages will become apparent to those skilled in the art to which this invention pertains from the following description and claims.

BRIEF DESCRIPTION OF THE INVENTION

In accordance with the present invention there is described a molten metal handling system, particularly useful for delivering high melting temperature metals in their molten state from a melting pot or crucible to a casting machine, e.g. die caster, strip caster, sand molds and the like, remote from the melting pot or crucible without exposure to the ambient atmosphere. The essential elements of the present molten metal handling system are a pump having no external cooling means yet is totally immersible into the molten metal and heated conduits to carry the molten metal to the casting station. Preferred elements in addition to the pump and conduit are flowmeters and flow control elements. Optionally, two or more sources of molten metal, e.g. two remote crucible or melting pots, can be tied together to provide a continuous source of metal to the die caster or strip caster.

DETAILED DESCRIPTION OF THE INVENTION

Figure 1:
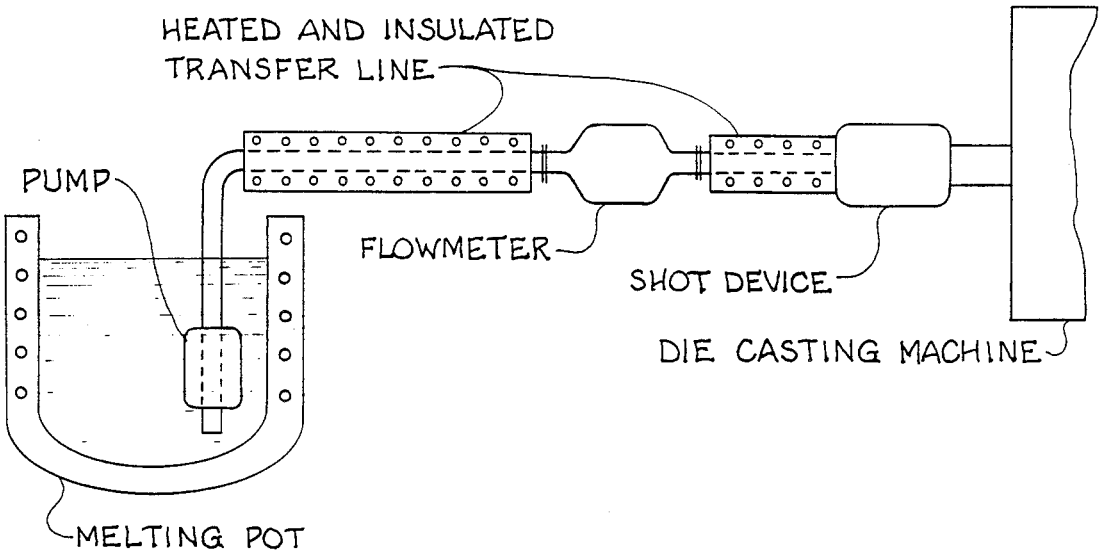
FIG. 1 represents in schematic diagram in elevation of a preferred embodiment of the present invention illustrating the relative placement of the elements which combine to achieve a molten metal handling system in accordance with the present invention.
Figure 2:
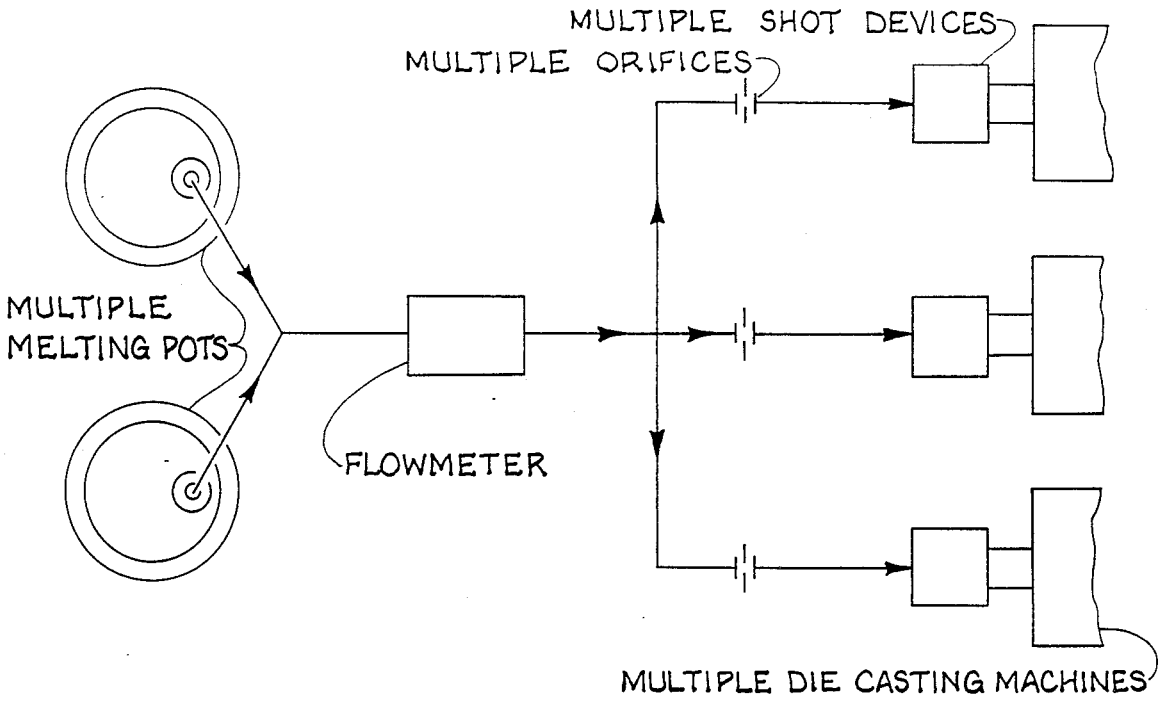
FIG. 2 represents a top view of a two crucible melting pot molten metal source to feed three die casting machines requiring different shot volumes of metal illustrating the flow restriction element in each heated pipe to distribute the metal in proper volume to their respective shot size and delivery means.

In accordance with the present invention and with particular reference to FIG. 1 of the drawings, a crucible or melting pot (10) remotely located with respect to a die casting machine (11) is connected to the die casting machine (11) by means of a linear annular electromagnetic pump (12) having no cooling means which is inserted into the crucible or melting pot (10) to a position below the surface of a molten metal which will be held by the crucible or melting pot (10). The pump (12) is connected at its outlet end (13) to one or more conduits (14), a sufficient number to carry the molten metal from the pump (12) outlet (13) to the die casting machine (11). Intermediate to the conduit (14) length there is located in line with the conduit (14) a flowmeter (15) which may be of the annular linear induction or flat linear induction flowmeter design and at the outlet of the conduit (14) attached is a shot size and delivery apparatus which is connected to the nozzle (16) for the die caster (11). It is also contemplated that flow control means in the nature of orifices may be inserted in to the conduits before or after a flowmeter if more than one die casting machine is to be used from the same melting pot or pots and a single pressure is preferred for conducting the molten meatal to the die casting machines.

The crucible or melting pot (10) is insulated (17), may have a cover (18) and is heated with either gas fired burners or electrical resistance heaters (19). The crucible or melting pot (10) is of any present day design, the shape, size and number not being critical. Of course, the number and size should be sufficient to enable continuous operation during each shift of casting.

The die casting machine (11) is any standard present day high or low pressure continuous or intermittent casting machine, sand molding table(s) or the like. It is to be understood that the system described above can also supply a strip caster.

THE PUMP

Figure 3:
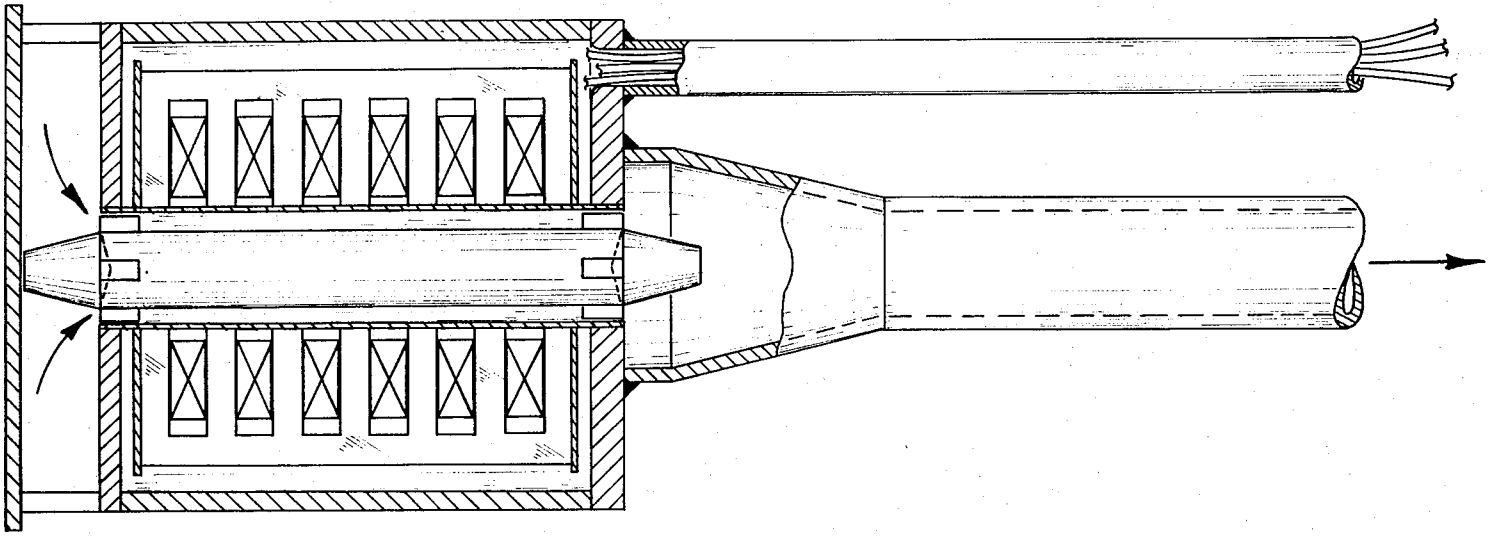
FIG. 3 shows in partial isometric cross section the pump utilized in accordance with the present invention.

The pump (12) is of the improved design and construction described in my copending application Ser. No. 720,434, filed Apr. 5, 1985, identified above, which is incorporated in toto herein. The pump (12) is of appropriate diameter and power to supply the requisite volume of metal at the desired pressure to the die casting machine(s) or strip casters. The pump (12), shown in more detail in FIG. 3, consists of a central tubular member about which are positioned six windings of deoxygenated flat copper within four or more cobalt steel laminated core members housed and sealed within a cover member welded to the exterior of the central tube, leaving several inches of each end of the tube extending beyond the housing to perform as inlet and outlet for the metal being moved by the magnetic field generated by the windings. Interior of the tube is a core rod, again made from a cobalt steel alloy, centered within the internal diameter and held thereat by guides. In order to operate the pump without external cooling it is essential that the conventional mica normally used for electrical insulation be heat treated to at least the maximum temperature to which the pump will be subjected to internally, prior to assembly in the pump windings and core laminates. In addition cobalt steel alloy is the preferred if not essential metal of construction for the laminations and the central core member. Further, it is necessary to employ deoxygenated copper in the windings if long life and trouble free service is desired in high temperature applications, e.g. magnesium service. In addition, it is desirable to pad the windings with a non-oxidizing gas such as argon.

THE FLOWMETER

Figure 5:
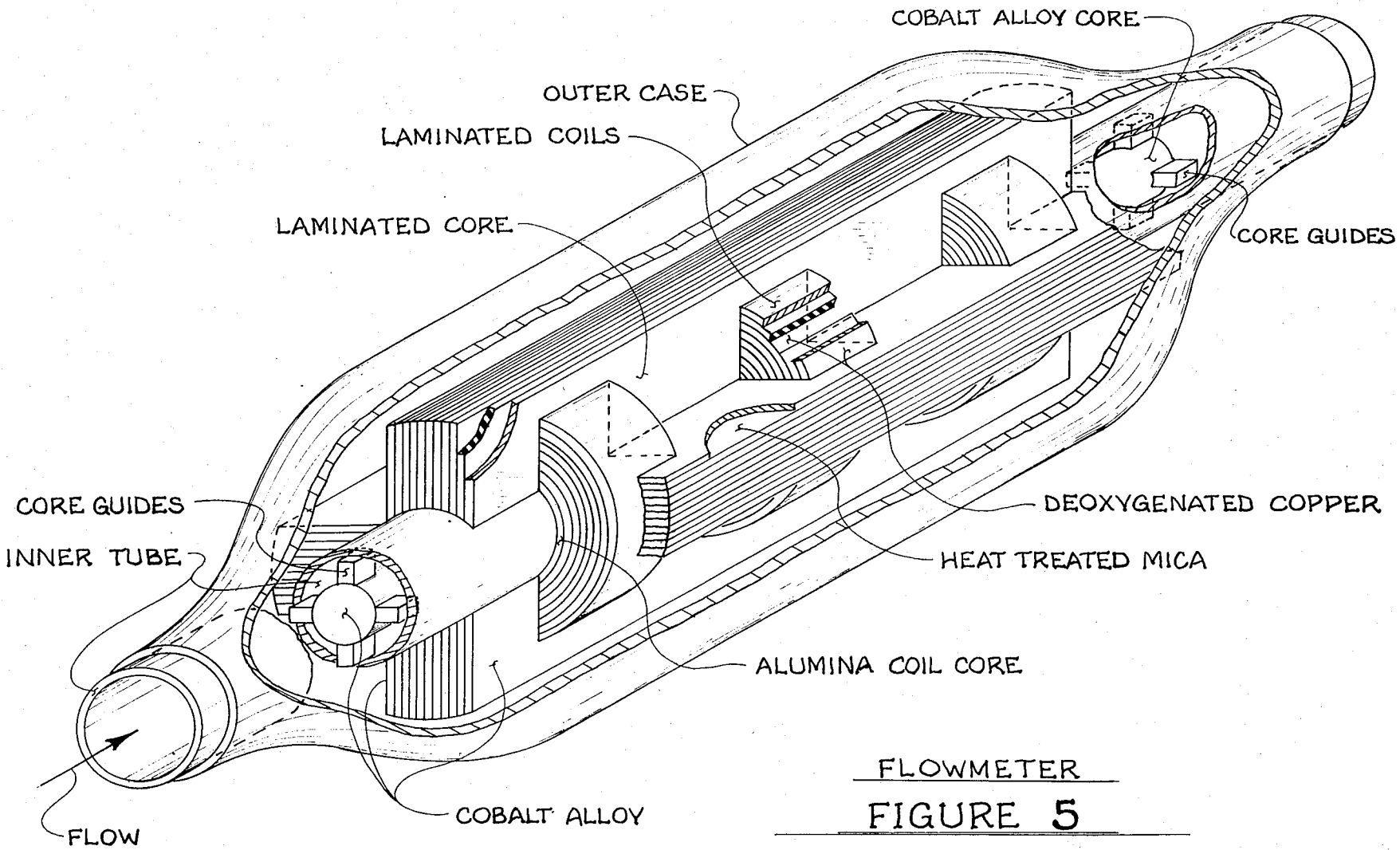
FIG. 5 shows a partial isometric of an annular linear induction flowmeter which may be employed in practicing the present invention; and, FIG. 6 shows in partial isometric a flat linear flowmeter which may be employed in the practice of the present invention.

The flow meter employed in the present invention FIG. 5 is a modified version of the annular linear electromagnetic pump as more fully described in my copending application Ser. No. 743,442, which is incorporated in toto herein, having three or five coils.

Figure 6:
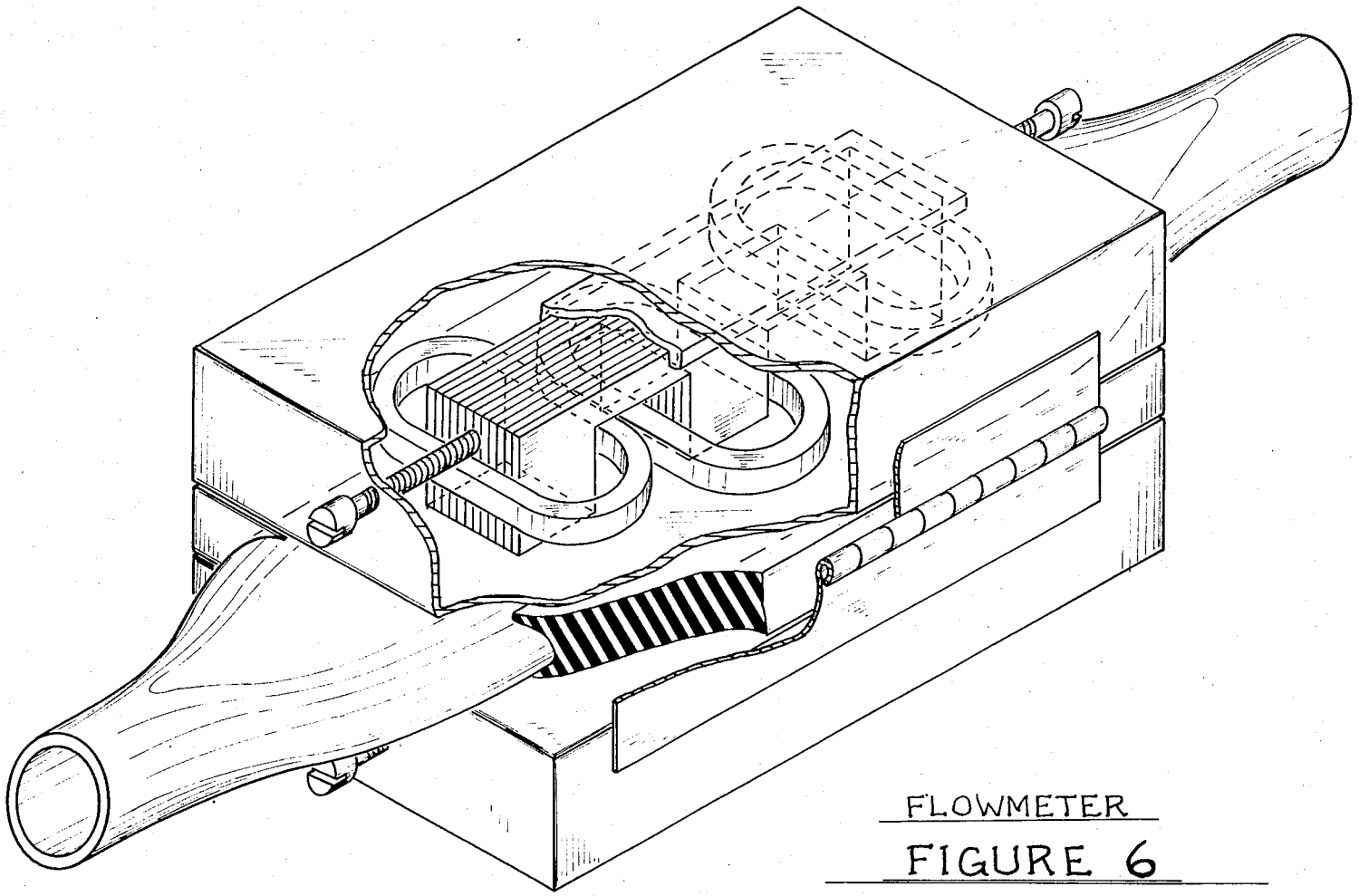

The alternate coils, beginning with the outer most coils, are wired in series to give a magnetic field across the metal passing beneath them which generates currents across the face of the intermediate coil(s) which generates a voltage within the coil winding which gives a measure of the volume of metal flowing through the meter. Another flowmeter of the design illustrated in FIG. 6, a flat linear induction flowmeter, useful herein is set forth in my copending application Ser. No. 741,939 identified above and which is incorporated by references herein.

THE CONDUITS

The conduits (14) are essentially tubular metal 14(*a*) pipes, such as Schedule 40, carbon steel pipe, although other materials may be used depending on the composition and the tendency of the molten metal, such as magnesium to extract minor alloy components from the surface. Surrounding the tubular member 14(*a*) are a series of electrical resistance heating rods 14(*b*), such as Calrod units, preferably capable of carrying 220–240 volts AC power. The power to these rods 14(*b*) is controlled through a power switching mechanism 14(*e*). Operation of the switching mechanism is controlled by thermal switch 14(*c*) which upon sensing that the tube has achieved a designated temperature, several degrees above the melting point of the magnesium metal, will intermittently switch the electrical power on and off as needed to maintain the conduit at the requisite temperature. It is well known that operating at reduced voltages will extend the service life of the resistance heating rods therefore the unit operates initially on 220–240 volts, but upon reaching a temperature of from one to several hundred degrees below the melting temperature of the metal can be and preferrably is, switched to 110–120 volts AC to continue the heating to the desired temperature and is thereafter maintained on the 110–120 volt circuit to maintain the temperature. The thermal switch is controlled by thermocouple 14(*d*) which is adjunct to the thermal switch 14(*c*) which latter in turn operates the power switching mechanism 14(*e*), which delivers the correct voltage (power) to the Calrods. It is of course to be understood, that the thermal switch 14(*c*) may be replaced with more sophisticated control means, such as, two three or more mode automatic controllers. The entire assembly of the tube, Calrod and the thermocouple are encased in an insulating medium, 14(*f*) such as, an alumina/silicon oxide fiber blanket, one such being a material sold under the tradename Fiberfrax. The connection of the tubular members 14(*a*) one to the other may conveniently be as illustrated, a clamp 14(*i*) which requires a ring 14(*g*) to be secured at each end of each tubular member 14(*a*), which ring and its encompassed tubular end 14(*h*) is clamped to another similarily designed tubular member by a split clamp 14(*i*) which fits snuggly over the rings of each of the two abutting tubular members 14(*a*) and upon being drawn tight in its encirculating mode by bolt and nut 14(*j*) and 14(*k*), respectively, brings one tubular member in sealing abutting relation to the other.

THE SHOT SIZING AND DELIVERY MECHANISM

Figure 4:
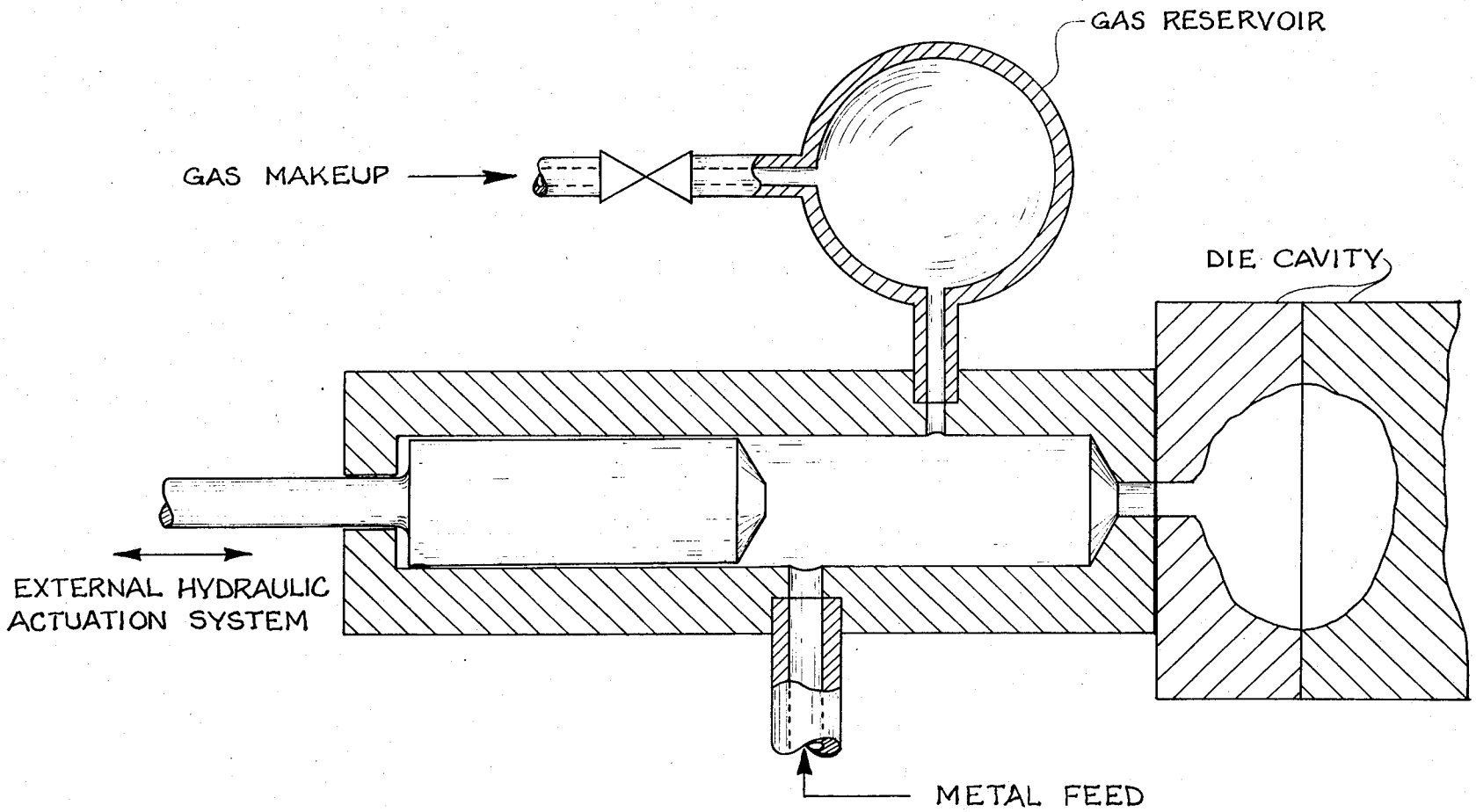
FIG. 4 illustrates the shot size and delivery apparatus in detail.

In modern day die casting machines, it is essential that the molten metal be delivered in amounts and under pressures such that the die will be filled but not over filled. In accordance with the present invention the molten magnesium is brought to the die machine 11 by the tubular members 14 to a shot delivery device (20), which in this embodiment is a hydraulically operated ram/chamber, as illustrated in FIG. 4. The device 20 is comprised of a ram 21 movably positioned in a chamber 22. The chamber has a molten metal inlet 23 and a gas inlet 23 on opposite sides of the chamber 22. The gas inlet 23 is associated with a gas chamber 24 which is supplied with a souce of protective gases. In operation a hydraulic ram 21 is programmed to be retracted allowing delivery of the molten metal at a positive head for a period of time to supply the correct amount of metal to chamber 22 sufficient to fill the die 11. This parameter is usually controlled by a time based sequence calculated to allow an amount of metal to flow into the chamber 20 under the chosen positive head of the pump 12. Upon the time period passing the ram 21 moves forward and closes off the inlet 23 to the chamber 20 and then proceeds to move rapidly forward pushing the metal into the cavity of the die 11. When the ram 21 is in its full forward position, and in sequence with the solidification period of the metal in the die, the ram retracts and as it passes the metal inlet 23, molten metal flows into the chamber 22, it also passes gas inlet 23 where upon a substantially non-oxidizing gas feed to a reservoir 24 located above the inlet 23 which will flow into the ram chamber 22 and into the die 11 during the period of ram retraction. The die has of course opened, ejected the molded article, closed and is ready to receive the next shot. The gas blows the die cavity free of most of the ambient air which has filled the die cavity during the ejection and closing steps.

In addition to the elements shown in FIG. 1 and aforedescribed there may be included provision to supply molten metal to several machines. The technique for accomplishing this permits machines drawing molten metal from a single source to use different volumes or draw a supply for two or more strip casters. This result is accomplished by placing an orifice plate in each line to a machine, sized to deliver, under a constant pressure, a measured volume of metal per unit time. Thus, by providing a constant pressure developed by the pump one can cast several different size articles or several plates at the same time.

What is claimed is:

1. A method for delivering molten metal from a molten metal source, a melting or holding pot, to a desired location, including a mold or die, without exposure of the molten metal to the atmosphere, which comprises (1) pumping said molten metal from said molten metal source employing a pump having no external cooling means employing a conventional mica which has been heat treated to at least the maximum temperature to which the pump will be subjected and operating on the principle of magnetohydrodynamics (MHD) completely immersed in the molten metal source, (2) transporting the molten metal from the outlet of said pump through a heated conduit or series of heated conduits providing a path for molten metal delivered by the pump to access the desired use location, said conduits being insulated electrically heated tubes non-reactive with the metal being carried.

2. The method of claim 1 wherein intermediate said pump and said desired location there is provided a metal flow measuring device consisting of a three or five coil MHD apparatus wherein the middle coil or 2nd and 4th coils generate a voltage from the current developed on the molten passing the said coil, the outer coils being powered.

3. The method of claim 1 wherein intermediate said pump and said desired location there is provided;

(a) a metal flow measuring device consisting of an annular linear three or five coil MHD apparatus wherein the middle or 2nd and 4th coils generate a voltage from the current developed on the molten metal passing the said coil(s), the outer coils of said three coil apparatus and the outer and 3rd coils of the five coil apparatus being powered;

(b) a shot size measuring and delivery means consisting of a shot delivery device having a chamber, a molten metal inlet, an inert gas inlet and a cylinder for moving molten metal which on movement forward seals the molten metal inlet then the gas inlet as it moves the metal into the mold, and opens the gas inlet and then the molten metal inlet as it, the cylinder, is retracted from it forward position, said cylinder being of a size sufficient to contain and deliver, under appropriate pressure of the metal at the metal inlet, the desired amount of metal to the mold.

4. The method of claim 1 wherein intermediate said pump and said desired location there is provided:

(a) a metal flow measuring device consisting of a flat linear three or five coil MHD apparatus wherein the middle coil or 2nd and 4th coils generate a voltage from the current developed on the molten metal passing the said coil, the outer coils being powered, (b) a shot size measuring and delivery means consisting of a shot delivery device having a chamber, a molten metal inlet, an inert gas inlet, a molten metal movement and gas and molten metal inlet sealing cylinder for delivering the measured amount of molten metal from the conduit located in said system adjacent to the sprue of said die casting machine die.

5. The method of claim 1 wherein a series of two or more die casting machines are fed molten metal from at least one or more inter connected melting pots and wherein intermediate said pump and said desired location there is provided:

(a) a metal flow measuring device consisting of a linear three or five coil MHD apparatus wherein the middle coil or 2nd and 4th coils generate a voltage from the current developed on the molten metal passing the said coil, the outer coils being powered, (b) a shot size measuring and delivery means consisting of a shot delivery device having a chamber, a molten metal inlet, an inert gas inlet, a molten metal movement and gas and molten metal inlet sealing cylinder for delivering the measured amount of molten metal from the conduit located in said system adjacent to the sprue of each associated die casting machine, and each shot size and delivery means being connected to said main conduit by a separate conduit having an orifice therein proportionated to provide the required metal volume necessary to fill the specific mold at the pressure selected for the system.

* * * * *